US011293256B2

(12) United States Patent
Goodman et al.

(10) Patent No.: US 11,293,256 B2
(45) Date of Patent: Apr. 5, 2022

(54) SEALING ELEMENT SUPPORT RINGS FOR DOWNHOLE PACKERS

(71) Applicant: Weatherford Technology Holdings, LLC, Houston, TX (US)

(72) Inventors: Brandon Goodman, Sugarland, TX (US); Cesar Garcia, Katy, TX (US); James Rochen, Waller, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 9 days.

(21) Appl. No.: 16/896,185

(22) Filed: Jun. 8, 2020

(65) Prior Publication Data

US 2021/0381334 A1 Dec. 9, 2021

(51) Int. Cl.
*E21B 33/129* (2006.01)
*E21B 33/128* (2006.01)

(52) U.S. Cl.
CPC ..... *E21B 33/129* (2013.01); *E21B 33/128* (2013.01); *E21B 2200/08* (2020.05)

(58) Field of Classification Search
CPC .. E21B 2200/08; E21B 33/128; E21B 33/129; E21B 33/12; E21B 33/1216; E21B 33/1208
See application file for complete search history.

(56) References Cited

U.S. PATENT DOCUMENTS

| | | | | |
|---|---|---|---|---|
| 3,306,362 | A * | 2/1967 | Urbanosky | E21B 33/1204 277/339 |
| 6,796,376 | B2 * | 9/2004 | Frazier | E21B 33/129 |
| 7,168,494 | B2 * | 1/2007 | Starr | E21B 33/12 166/192 |
| 8,641,113 | B1 * | 2/2014 | Russell | E21B 31/00 294/86.1 |
| 9,359,863 | B2 * | 6/2016 | Streich | E21B 33/1204 |
| 10,619,446 | B2 * | 4/2020 | Webster | E21B 33/1293 |
| 2011/0024134 | A1 * | 2/2011 | Buckner | E21B 33/1204 166/382 |
| 2013/0186646 | A1 * | 7/2013 | Xu | E21B 33/129 166/382 |
| 2014/0311752 | A1 * | 10/2014 | Streich | E21B 33/1204 166/376 |
| 2015/0047907 | A1 * | 2/2015 | Buytaert | E21B 17/1028 175/57 |
| 2017/0260825 | A1 * | 9/2017 | Schmidt | E21B 33/129 |
| 2017/0350211 | A1 * | 12/2017 | Ingram | E21B 33/1216 |
| 2018/0195363 | A1 * | 7/2018 | Hofstee | E21B 33/1208 |
| 2021/0054704 | A1 * | 2/2021 | Merron | E21B 33/1291 |
| 2021/0054719 | A1 * | 2/2021 | Nichols | E21B 34/12 |

FOREIGN PATENT DOCUMENTS

| | | | | |
|---|---|---|---|---|
| WO | WO-2017123198 | A1 * | 7/2017 | E21B 33/128 |
| WO | WO-2017196341 | A1 * | 11/2017 | E21B 23/06 |

* cited by examiner

*Primary Examiner* — Daniel P Stephenson
(74) *Attorney, Agent, or Firm* — Peter V. Schroeder; Booth Albanesi Schroeder PLLC

(57) ABSTRACT

A downhole tool with a radially expandable sealing element, such as a packer or plug. The sealing element employs metallic support rings disposed on the sealing element outer surface for preventing extrusion during run-in and for clamping the sealing element to the tool.

20 Claims, 3 Drawing Sheets

SEALING ELEMENT SUPPORT RINGS FOR DOWNHOLE PACKERS

TECHNICAL FIELD

The disclosure generally relates to tools used downhole in oil and gas wellbores. More specifically, the disclosure relates to expansion apparatuses used to anchor downhole tools in wellbores.

DESCRIPTION OF RELATED ART

In drilling, working, and production of oil and gas wells, a variety of downhole tools are run into the wellbore and employed downhole. The wellbore can be open-hole, where the subterranean formation defines the wellbore wall, but is often lined with casing which can be cemented into place. Downhole tools are often run-into the wellbore on a tubing string or coiled tubing to a desired depth, and then anchored within the wellbore or casing. It is often desirable to temporarily plug the wellbore, or seal an annular space defined between a tubing string and the casing. Such downhole tools include plugs, packers, bridge packers, and the like, and can be used for cementing, fracturing, work-over, sand packing, propping, water flood, and other operations. During such operations a fluid, such as a slurry or fracturing fluid, can be transported down the tubing string or the annulus between the string and the casing. A cross-over tool can be used to switch fluid flow from the annulus to the string, or vice versa.

During such operations it is often necessary to seal the annulus between the tubing and the casing, to prevent fluid pressure from lifting the tubing out of the wellbore, or for isolating selected zones in the formation. Among other tools, packers are designed for these general purposes. Packers use a radially expandable sealing element to seal the tubing annulus. Sealing elements, however, are not generally sufficient to anchor the tubing in the wellbore or to prevent extrusion and eventual failure of the sealing element. Typically, packers rely on slip rings which radially expand to grippingly engage the wellbore wall to anchor the tool in the casing. Such anchoring and sealing is required for many applications of downhole tools within the wellbore.

Problems are encountered in the use of sealing elements. During run-in, the sealing elements can be prone to extrude, deform, or "swab," due to the dragging action of fluid flowing between the seal element and casing or from the seal elements dragging along the casing. Once in a radially expanded "set" position, the seal elements can be prone to extrude due to differential pressure across the element, relative movement of the set tool with respect to the casing, and the like. While there are a number of sealing element designs and materials available, there is a need for apparatus to slow or prevent seal element extrusion.

BRIEF DESCRIPTION OF THE DRAWINGS

For a more complete understanding of the present invention, and the advantages thereof, reference is now made to the following description which is to be taken in conjunction with the accompanying drawings in which like reference numerals indicate like parts and wherein.

DETAILED DESCRIPTION OF EMBODIMENTS OF THE DISCLOSURE

Figure 1:
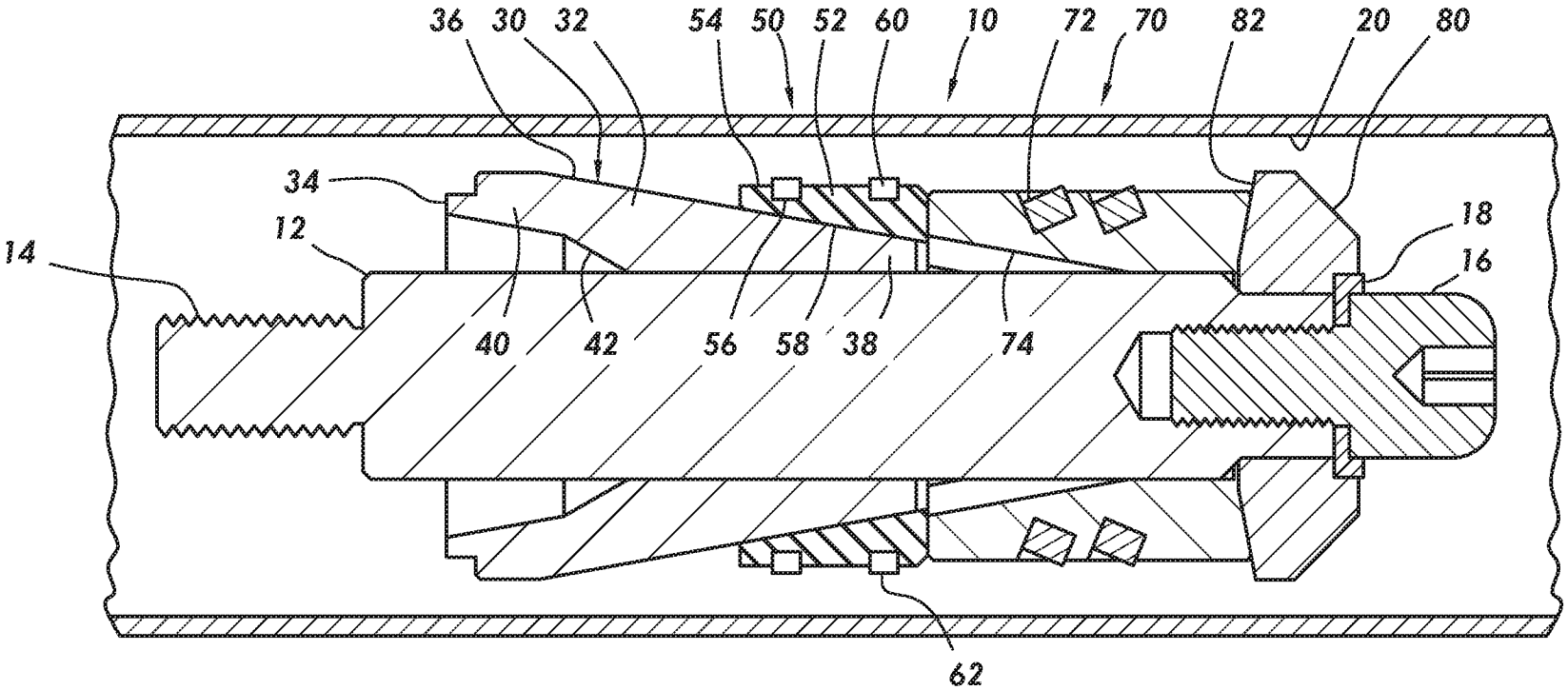
FIG. 1 is a longitudinal, cross-sectional view of an exemplary downhole tool embodying aspects of the disclosure, show in in a run-in configuration.

In the drawings and description, like parts are typically marked throughout the specification and drawings with the same reference numerals, respectively. The figures are not necessarily to scale. Certain features of the invention may be shown exaggerated in scale or in somewhat schematic form and some details of conventional elements may not be shown in the interest of clarity and conciseness.

The disclosure herein will focus on a drop-ball plug, however, a person of skill in the art will recognize that the principals of the disclosure can be used on packers, drop-ball and carried- or caged-ball plugs, frac or bridge plugs, whether retrievable, drillable, dissolvable, or otherwise, and on other downhole tools for sealing a wellbore using one or more radially expandable sealing elements. Generally, such tools have a generally cylindrical tool body or mandrel; a sealing assembly having at least one radially expandable sealing element for sealingly engaging the wellbore wall; a radially expandable slip assembly for grippingly engaging the wellbore wall; and one or more wedges or cones movably mounted on the tool body for radially expanding the sealing elements and slip assembly.

Figure 2:
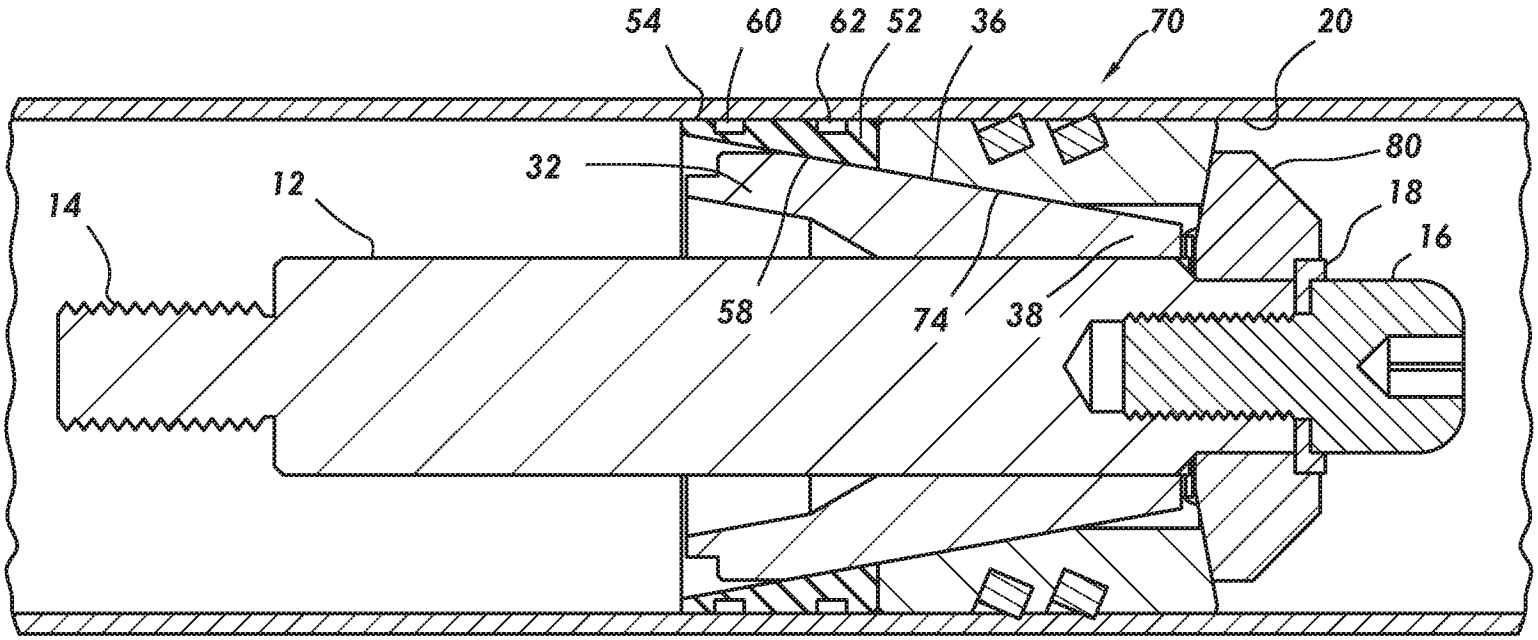
FIG. 2 is a longitudinal, cross-sectional view of the tool of FIG. 1, shown in a radially expanded or preliminary set position, according to aspects of the disclosure.
Figure 3:
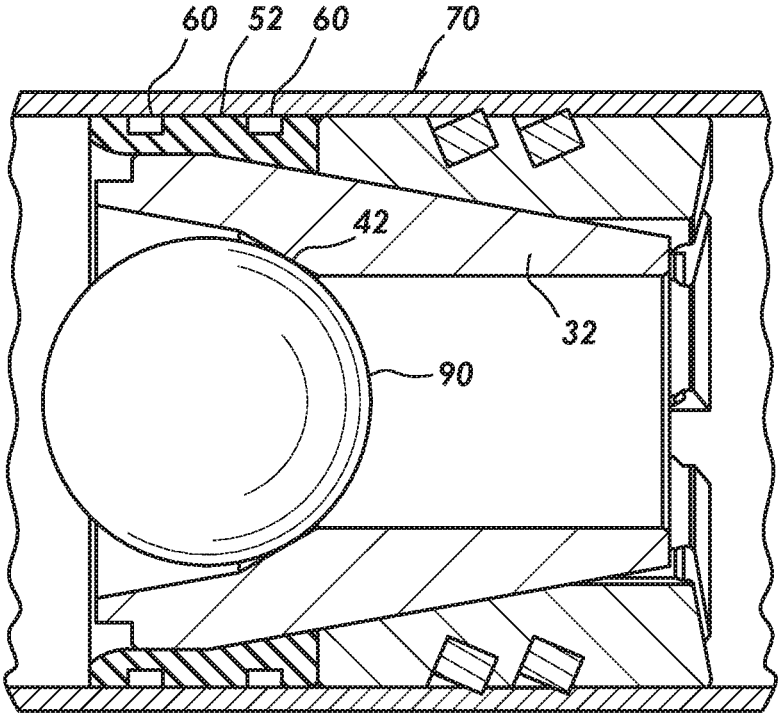
FIG. 3 is a longitudinal, cross-sectional view of the downhole tool of FIGS. 1 and 2, shown in a set position, with the tool body removed and a seated plug ball, according to aspects of the disclosure.

FIG. 1 is a longitudinal, cross-sectional view of an exemplary downhole tool embodying aspects of the disclosure, show in in a run-in configuration. FIG. 2 is a longitudinal, cross-sectional view of the tool of FIG. 1, shown in a radially expanded or preliminary set position, according to aspects of the disclosure. FIG. 3 is a longitudinal, cross-sectional view of the downhole tool of FIGS. 1 and 2, shown in a set position, with the tool body removed and a seated plug ball, according to aspects of the disclosure.

Tool Body

A downhole tool 10 is presented having a tool body 12, a wedge assembly 30, a sealing assembly 50, and a slip assembly 70. The tool body 10 is generally cylindrical, defines a longitudinal axis of the tool, and acts to carry, directly or indirectly, the other tool components during run-in and setting of the tool. In the embodiment shown, the tool body 12 is disconnected from the wedge assembly 30, sealing assembly 50 and slip assembly 70 after setting of the tool downhole, and retrieved from the wellbore to the surface. In other embodiments, the tool body 12 remains in the wellbore, supporting the other tool components after setting and during use. The illustrated tool body 12 is generally solid in cross-section, however, it is also known in the art to provide a tool body defining a longitudinal passage therethrough for selective fluid flow through and past the tool.

The tool body 12 has an upper end 14 for connection to a tubing string, coiled tubing, wireline or the like for maneuvering the tool in the wellbore. The tool 10 cooperates with a setting tool, not shown, for setting the tool by axially shortening and radially expanding both the sealing assembly 50 and the slip assembly 70, typically by forcing the wedge assembly 30 axially under the sealing and slip assemblies.

Setting tools and their use is known in the art and not described in detail here. Setting tools can be operated hydraulically, mechanically, electrically, or explosively.

The tool body 12 can also carry a shoe 16 on its lower end, shown attached to the tool body 12 by threaded connection. Release mechanisms 18 temporarily connect the tool body 12 to the tool components that remain downhole. Release mechanisms are known in the art and not described in detail here. Release mechanisms can include shear rings, shear pins, collet assemblies, J-hook connections, and the like.

In the embodiment shown, the tool body 12 is released or disconnected from the remaining tool components, such as the release mechanisms 18, and retrieved to the surface after the tool is set. As seen in FIG. 3, the tool body 12 has been removed, leaving the wedge 32, sealing element 52, support rings 60, and slip assembly 70 in the set position in the wellbore.

Wedge Assembly

The wedge assembly 30 includes a wedge 32 or cone for radially expanding the sealing assembly 50 and slip assembly 70. The wedge 32 shown is slidably and axially movable along the tool body 12 during setting. In some embodiments, the tool body and wedge are monolithic, as is known in the art. In further embodiments, multiple wedges are employed, typically in opposed arrangement to radially expand multiple slip assemblies used in some bi-directional plugs and packers, or having a wedge for expanding a slip assembly and a separate wedge for expanding a sealing assembly. In the embodiment shown, the wedge 32 defines an upper annular shoulder 34 for contact by a setting tool (or components intermediate the wedge and setting tool).

The wedge 32 defines an exterior generally conical outer surface 36 for radially expanding the seal and slip assemblies. It is understood that the generally conical surface can include a plurality of flat surfaces or facets as is known in the art. The wedge 32 is shown as a monolithic component, but it is understood that the wedge 32 can instead be formed of a number of separate or separable wedge pieces, again as known in the art.

The wedge 32 has a narrow-diameter leading end 38 and a wide-diameter trailing end 40. In the embodiment shown, the wedge end 38 is positioned radially inward from the sealing assembly 50 in the run-in position but not positioned radially inward from the slip assembly. Alternate arrangements are possible and known in the art. For example, the wedge can be positioned radially inward from both the sealing and slip assemblies in the run-in position, or can be positioned axially spaced from the sealing and slip assemblies. In the exemplary embodiment shown, the plug is a drop-ball plug and so defines a ball seat 42 for use in conjunction with a plug ball 90.

Sealing Assembly

The sealing assembly 50 includes at least one annular seal element 52 positioned around or about the tool body 12. That is, the seal element defines a ring surrounding the tool body circumferentially. In the embodiment shown, the seal element 52 is also positioned around or about, and contacting, the lower end 38 of the wedge 32 in the run-in position. Alternately, the seal element 52 can contact the tool body 12 or other tool components during run-in. In the shown embodiment, a single seal element 52 is employed, however, multiple stacked seal elements can be used, as is known in the art. In the embodiment shown, the seal element 52 defines an interior surface 58 which is generally conical and cooperates with the generally conical outer surface 36 of the wedge 32. Alternate interior shapes for the seal element are known in the art.

The seal assembly 50 and each seal element 52 is radially expandable from a run-in position, seen in FIG. 1, to a set position, seen in FIGS. 2 and 3. The seal assembly and elements are for sealingly engaging the wellbore wall 20, which can be open hole but more likely has a casing. The outer surface 54 of the seal element 52 contacts and fluidly seals against the wellbore wall. ("Wellbore wall" is used herein to denote either an open-hole wall or a casing disposed in the wellbore.) In the set position, the seal element 52 prevents fluid flow along an annulus defined between the tool body 12 or wedge 32 and the wellbore wall 20, or, in conjunction with other tool components, prevents flow along the wellbore.

The seal element 52 is made of an elastomeric material and is radially expandable and axially compressible. Seal element construction and materials are known in the art and practitioners will recognize alternate construction and materials.

Support Rings

Carried on an outer surface 54 of the seal element 52 are one or more support rings 60. Each support ring 60 is a unitary ring; that is, not a ring defined from numerous separated ring segments. The support ring 60 is radially expandable from a run-in position, seen in FIG. 1 to an expanded set position, seen in FIGS. 2 and 3. The support ring 60 can be positioned in a circumferential groove 58 defined in the seal element 52, as shown, with an outer surface 62 exposed. In some embodiments, the exterior surface 62 of the support ring 60 contacts the wellbore wall 20 when in the set position. In other embodiments, the support ring expands radially during setting of the tool but does not contact the wellbore wall. Instead, the outer surface of the support ring expands less than the outer surface of the seal element, and in the set position the support ring is spaced radially inwardly from the wellbore wall.

During run-in, the support rings 60 prevent extrusion of the seal element 52 which can be caused by fluid flow in the annulus between the downhole tool and the wellbore wall 20. In some embodiments, the support rings 60 clamp the seal element 52 against the wedge 32 (or tool body 12). Such clamping forcefully seals the seal element inner surface 58 against an interior tool component such as, in the embodiment shown, the wedge 32. This prevents fluid from interposing between the seal element and the tool. Further, during run-in the support rings stiffen the seal elements 52, helping to maintain their shape and integrity. Multiple support rings 60 can be axially spaced apart along a seal element 52, as shown. Where multiple seal elements are used, support rings can be employed on the multiple seal elements.

The support rings 60 shown in the embodiment are made of metal. The support rings can be made of aluminum, steel, iron, magnesium, or other metals and alloys. In some embodiments the support rings 60 are dissolvable, degradable, or disintegrable. For example, aluminum and magnesium support rings are dissolvable by chloride solutions, acid solutions and/or fresh water.

Slip Assembly

The slip assembly 70 is positioned around or about the tool body 12. Slip assemblies are known in the art and will not be discussed in detail here. The slip assembly 70 can comprise a plurality of slip segments or a monolithic slip, as is known in the art. Where slip segments are employed, the segments are often maintained on the tool during run-in with frangible retaining rings and the like, as is known in the art. Where a monolithic slip is employed, it is often frangible into slip segments during radial expansion, such as along predetermined lines (e.g., grooves) defined for that purpose.

Positioned extending radially from the slip assembly are anchor mechanisms 72 for grippingly engaging the wellbore wall. Anchor mechanisms are known in the art and can comprise teeth, ridges, roughened surfaces, ceramic buttons, and the like.

The slip assembly moves from a run-in position, seen in FIG. 1, to a radially expanded set position, seen in FIGS. 2 and 3. In the radially expanded position, the slip assembly grippingly engages the wellbore wall, thereby maintaining the tool in position downhole. In the run-in position, the slip assembly 70 is positioned around or about, and contacting, the tool body 12, as seen. Alternately, the slip assembly can be positioned around or about, and contacting, the wedge 32 or other tool components. During setting, the wedge 32 moves axially, interior to the slip assembly 70, and radially expands the slip assembly. In the shown embodiment, a single slip assembly is employed, however, multiple slip assemblies can be used, as is known in the art. In the embodiment shown, the slip assembly 70 defines an interior surface 74 which is generally conical and cooperates with the generally conical outer surface 36 of the wedge 32. Alternate interior shapes for the seal element are known in the art.

Bottom Sub

A bottom sub 80 is positioned on the lower end of the tool boy 12. The bottom sub 80 provides a shoulder 82 to push against the slip assembly 70 during setting of the tool and to maintain the slip assembly on the tool during run-in. In some embodiments, the bottom sub is radially expandable. In the embodiment shown, the bottom sub is attached to the tool body 12 by release mechanisms 18, such as shear rings, shear pins, collet assemblies, dissolvable pins or fasteners, and the like. The bottom sub in the embodiment shown, is stroked upward until the tool is set, and then released and separated from the tool at the shear pins, falling into the wellbore. The bottom sub can be dissolvable, such that it does not remain as an impediment in the wellbore. Bottom subs are known in the art and are not discussed in detail here.

Anti-Extrusion Rings

Figure 4:
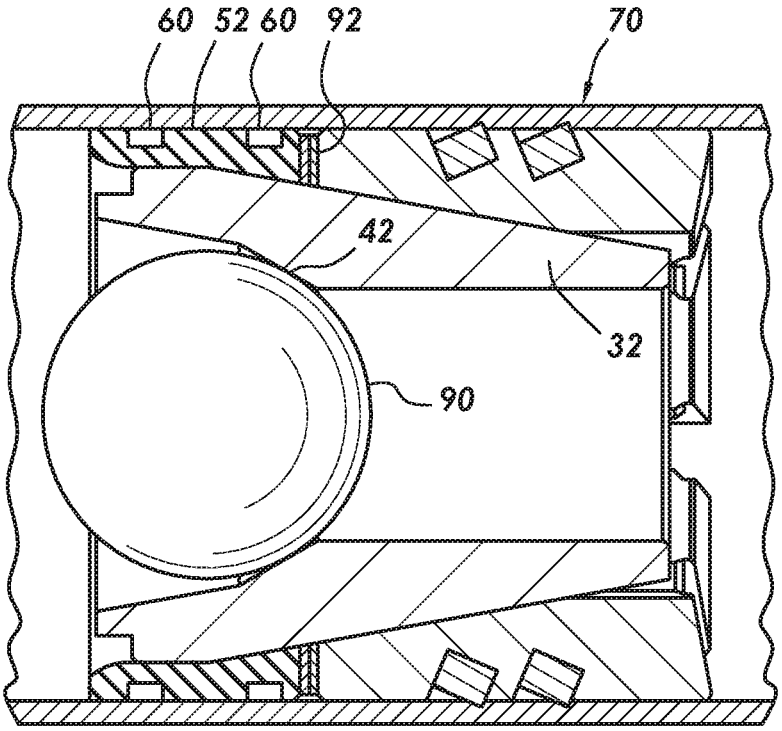
FIG. 4 is a cross-sectional view of another embodiment according to aspects of the disclosure, seen in a set position.

FIG. 4 is a cross-sectional view of another embodiment according to aspects of the disclosure, in the set position. FIG. 4 is similar to FIG. 3 and is discussed only with respect to differences therebetween. FIG. 4 shows anti-extrusion rings 92 positioned between the sealing element 52 and the slip assembly 60. Such anti-extrusion rings are known in the art and so not disclosed in detail here. Anti-extrusion rings can be used in conjunction with the sealing assembly and support rings described herein. Anti-extrusion rings 92 can be positioned at upper and/or lower ends of the sealing elements 52. Such anti-extrusion rings can take any known or later developed form. For example, some anti-extrusion rings comprise little more than washer-like metal discs. Other anti-extrusion rings are expandable from a run-in to a set position, where the rings expand to provide axial support to the axial ends of the expanded sealing element. Such rings can have deformable annular flanges, comprise petal-like, overlapping flaps, or take other forms as are known in the art.

Operation

In use, the tool 10 is run downhole in a wellbore on a tool string, coiled tubing, wireline or the like to a selected location. The tool is initially in a run-in position, as seen in FIG. 1. In the run-in position, the sealing assembly 50 and slip assembly 70 are in a run-in position, generally spaced from the wellbore wall, such that the tool can be run downhole.

Once in a desired location, the tool is set, such as by a setting tool (not shown), to a preliminary set position as seen in FIG. 2. During setting, the wedge 32 is driven axially towards the bottom sub 80, with the conical surface 36 of the wedge 32 forcing the sealing assembly 50 and slip assembly 60 radially outward towards the wellbore wall. The sealing assembly 50 is also typically axially shortened by action of the slip assembly 60 (or other tool component) and the wedge 32, setting tool, or other tool component.

During setting, the sealing element 52 is radially expanded into sealing engagement with the wellbore wall. The sealing element 52 is radially expanded by the wedge 32 which moves axially with respect to the sealing element. The cooperating conical surfaces 36 and 58 of the wedge 32 and sealing element 52, respectively, operate to force radial expansion of the sealing element. The wedge 32 then remains in position radially inward from the sealing element 52, supporting it in the radially expanded or set position.

During setting, the support rings 60 are also radially expanded due to the movement of the wedge 32 under the sealing element 52. The support rings 60 expand radially at a different rate than the sealing element. As setting begins, the wedge 32 expands the sealing element 52 while the support rings 60 temporarily remain unexpanded. As the sealing element 52 expands, the element is clamped and compacted between the wedge 32 and support rings 60. Eventually, the sealing element 52 also causes radial expansion of the support rings. The different rates of expansion of the element and support rings can cause the outer surface 54 of the sealing element 52 to extend radially beyond the outer surface 62 of the support rings 60. In some embodiments, radial expansion of the sealing element 52 will eventually cause the support rings 62 to break.

During setting, the slip assembly 70 is radially expanded into gripping engagement with the wellbore wall. The slip assembly 70 is radially expanded by the wedge 32 which moves axially with respect to the slip assembly. The cooperating conical surfaces 36 and 74 of the wedge 32 and slip assembly 70, respectively, operate to force radial expansion of the slip assembly. In some embodiments the slip assembly 70 is frangible and breaks into numerous slip segments during expansion, as is known in the art. In other embodiments, the slip assembly 70 comprises numerous slip segments maintained in position by retaining rings or the like. In such an assembly, the retaining rings break during setting, allowing the slip segments to radially expand into gripping engagement with the wellbore wall. The wedge 32 then remains in position radially inward from the slip assembly, supporting it in the radially expanded or set position.

In the embodiment shown, the tool body 12 is then released or disconnected from the remaining tool components, such as the release mechanisms 18, and retrieved to the surface after the tool is set. As seen in FIG. 3, the tool body 12 is removed, leaving behind the wedge 32, sealing element 52, support rings 60, and slip assembly 70 in the set position in the wellbore.

As seen in FIG. 3, the embodiment of the tool shown provides a seat 42 in the wedge 32 for cooperation with a valve element such as a drop or caged ball 90. Once the valve element is in place, the tool can hold against differential fluid pressure across the tool.

After the tool has completed its service in the wellbore, the tool can be removed from the wellbore. For example, in some embodiments the tool can be unset and retrieved from the wellbore. In the embodiment shown, the tool can be drilled out or dissolved and/or degraded to remove it from the wellbore. To dissolve or degrade the tool, solvents and solutions can be pumped downhole to contact and dissolve or degrade the tool components. In some embodiments, all of the tool components are dissolvable or degradable (expect often the ceramic buttons acting as slip teeth). Dissolvable and degradable materials suitable for downhole use are known in the art. For example, tool elements of aluminum or magnesium are dissolvable in acid solutions, chloride solutions, and/or fresh water.

CONCLUSION

A method of operating a downhole tool is disclosed, the method comprising: running a downhole tool into a wellbore having a wall, the downhole tool having an annular, elastomeric sealing element, and a plurality of metal support rings disposed around the sealing element; during running the downhole tool into the wellbore, maintaining the sealing element in position on the downhole tool using the support rings; radially expanding the sealing element into sealing contact with the wellbore wall; and radially expanding the support rings. The method above can further comprise: radially expanding a slip assembly into gripping engagement with the wellbore wall; dissolving or degrading the support rings after radially expanding the sealing element; while running the downhole tool into the wellbore, clamping the seal element against a wedge or body of the downhole tool using the support rings; while radially expanding the sealing element, clamping the seal element against a wedge or body of the downhole tool using the support rings; The method of claim 1, further comprising: radially expanding the sealing element and support rings at different rates; beginning to radially expand the sealing element, then radially expanding the support rings while continuing to radially expand the sealing element; and radially expanding the support rings into contact with the wellbore wall. A downhole tool for sealing a wellbore extending through a subterranean formation is disclosed, the downhole tool comprising: a tool body; a radially expandable sealing assembly mounted on the tool body for sealingly engaging a wall of the wellbore, the sealing assembly comprising at least one radially expandable, annular sealing element disposed about the tool body, the sealing element having at least one metal retaining ring disposed about an outer surface of the sealing element; a radially expandable slip assembly for grippingly engaging the wall of the wellbore; and at least one wedge, axially moveable in relation to the sealing assembly and slip assembly, the at least one wedge for radially expanding the sealing element assembly and slip assembly. The downhole tool can be used: wherein the sealing element is of elastomeric material and wherein the at least one support ring is metallic; wherein the wedge defines an internal passageway and a valve seat, the valve seat for receiving a valve element to seal the internal passageway; wherein the wedge, sealing assembly and slip assembly are carried on a tool body, and wherein the tool body is retrievable from the wellbore after expansion of the sealing assembly and slip assembly; wherein the at least one support ring is expandable into engagement with the wellbore wall; wherein the sealing element and support rings are dissolvable when downhole; and wherein the at least one support ring clamps the sealing element to the tool body or wedge. A downhole tool is disclosed comprising: a radially expandable seal element for sealingly engaging a wellbore wall, the seal element having an outer surface for contacting the wellbore wall; and a plurality of metallic support rings, each support ring disposed on the outer surface of the seal element. The downhole tool can be used: wherein each support ring is disposed in a corresponding groove defined in the outer surface of the seal element; wherein the metallic support rings and the seal element are dissolvable downhole after radial expansion.

While this disclosure has been described in reference to illustrative embodiments, this description is not intended to be construed in a limiting sense. Various modifications and combinations of the illustrative embodiments, as well as other embodiments of the disclosure, will be apparent to persons skilled in the art upon reference to the description. It is therefore intended that the appended claims encompass any such modifications or embodiments.

Terms such as "a" and "an" and "the" are not intended to refer to only a singular entity, but include the general class of which a specific example may be used for illustration. The terminology herein is used to describe specific embodiments of the disclosure, but their usage does not delimit the disclosure. The use of the word "a" or "an" when used in conjunction with the term "comprising" in the claims or the specification may mean "one," but it is also consistent with the meaning "one or more" and "at least one." The use of the term "or" in the claims is used to mean "and/or" unless explicitly indicated to refer to alternatives only or the alternatives are mutually exclusive, although the disclosure supports a definition that refers to only alternatives and "and/or."

As used in this specification and claims, the word "comprising" and any form thereof, the word "having" and any form thereof, the word "including" and any form thereof, or the word "containing" and any form thereof are inclusive or open-ended and do not exclude additional, unrecited elements or method steps. The term "or combinations thereof" as used herein refers to all permutations and combinations of the listed items preceding the term.

With respect to the description of methods herein, this specification hereby explicitly teaches and supports the use of the described method steps not only in the order described, but also in any other order a person of skill in the art would recognize as practicable. For example, unless stated otherwise, where the specification teaches the steps A, B, and C of a method, the specification hereby teaches a practitioner, and provides support for corresponding claims, that it is possible to practice the method using those steps in other orders (e.g., ACB, BAC, BCA, CAB, CBA). Further, the specification hereby teaches a practitioner and provides support for any such claims, of repeating some or all of the steps, and of providing intervening but untaught steps (e.g., AABC, ABCA, ABBCA, ABXC, AXBBYC, etc.). The skilled practitioner will and does understand that typically there is no limit on the number of steps or methods in any combination, unless otherwise apparent from context.

It is claimed:

1. A method of operating a downhole tool, the method comprising:

running a downhole tool into a wellbore having a wall, the downhole tool having a tool body, an annular, elastomeric sealing element disposed around the tool body, and a plurality of metal, unitary support rings disposed around and axially spaced apart along the sealing element;

during running the downhole tool into the wellbore, maintaining the sealing element in position on the downhole tool using the support rings, the support rings clamping the sealing element to the tool body or a wedge carried on the tool body;

radially expanding the sealing element into sealing contact with the wellbore wall; and radially expanding the support rings; and dissolving the support rings with the downhole tool in a downhole position in the wellbore.

2. The method of claim 1, further comprising: radially expanding a slip assembly into gripping engagement with the wellbore wall.

3. The method of claim 1, further comprising, dissolving the support rings after radially expanding the sealing element.

4. The method of claim 1, further comprising: dissolving the support rings after radial expansion of the sealing element.

5. The method of claim 1, further comprising: while radially expanding the sealing element, clamping the seal element against a wedge or body of the downhole tool using the support rings.

6. The method of claim 1, further comprising: radially expanding the sealing element and support rings at different rates.

7. The method of claim 1, further comprising: beginning to radially expand the sealing element, then radially expanding the support rings while continuing to radially expand the sealing element.

8. The method of claim 1, further comprising: radially expanding the support rings into contact with the wellbore wall.

9. A downhole tool for sealing a wellbore extending through a subterranean formation, the downhole tool comprising:

a tool body;

a radially expandable sealing assembly mounted on the tool body for sealingly engaging a wall of the wellbore, the sealing assembly comprising at least one radially expandable, annular sealing element disposed about the tool body, the sealing element defining a first and second end, the sealing element having two or more, unitary metal retaining rings disposed about an outer surface of the sealing element, the retaining rings spaced longitudinally from the first and second ends of the sealing element, the retaining rings of a material selected to dissolve when exposed to a selected fluid downhole in the wellbore;

a radially expandable slip assembly for grippingly engaging the wall of the wellbore; and a wedge for radially expanding the sealing element assembly and slip assembly.

10. The downhole tool of claim 9, wherein the two or more retaining rings further comprise: a first retaining ring spaced axially from the first end of the sealing element, and a second retaining ring spaced axially from the second end of the sealing element.

11. The downhole tool of claim 9, wherein the wedge defines an internal passageway and a valve seat, the valve seat for receiving a valve element to seal the internal passageway.

12. The downhole tool of claim 9, wherein the wedge, sealing assembly and slip assembly are carried on a tool body, and wherein the tool body is retrievable from the wellbore after expansion of the sealing assembly and slip assembly.

13. The downhole tool of claim 9, wherein the at least one retaining ring is expandable into engagement with the wellbore wall.

14. The downhole tool of claim 9, wherein the sealing element and retaining rings are dissolvable when downhole.

15. The downhole tool of claim 9, wherein the at least one retaining ring clamps the sealing element to the tool body or wedge.

16. A downhole tool comprising:

a tool body;

a radially expandable seal element for sealingly engaging a wellbore wall, the seal element carried by the tool body and having an outer surface for contacting the wellbore wall, the seal element having first and second axial ends, the seal element defining a plurality of circumferential grooves therein; and a plurality of metallic support rings, each support ring disposed in a corresponding circumferential groove of the seal element, the support rings axially spaced apart from one another and from the first and second axial ends of the seal element.

17. The downhole tool of claim 16, wherein each support ring is disposed in a corresponding groove defined in the outer surface of the seal element.

18. The downhole tool of claim 16, wherein the metallic support rings and the seal element are dissolvable downhole after radial expansion.

19. The downhole tool of claim 16, further comprising a radially expandable slip assembly for grippingly engaging the wellbore wall.

20. The downhole tool of claim 19, further comprising: wherein the seal element and the support rings radially expand at different rates.

* * * * *